US006309331B1

(12) United States Patent
Raymond

(10) Patent No.: US 6,309,331 B1
(45) Date of Patent: Oct. 30, 2001

(54) ABDOMINAL EXERCISER DEVICE

(76) Inventor: Jean-Guy Raymond, 745, rue Batiscan, Laval P.Q. (CA), H7E 4E8

( * ) Notice: Subject to any disclaimer, the term of this patent is extended or adjusted under 35 U.S.C. 154(b) by 0 days.

(21) Appl. No.: 09/502,236

(22) Filed: Feb. 11, 2000

Related U.S. Application Data

(60) Provisional application No. 60/120,043, filed on Feb. 12, 1999.

(51) Int. Cl.[7] ..... A63B 71/00

(52) U.S. Cl. ..... 482/148; 482/132; 482/140; 601/19; 601/63

(58) Field of Search ..... 482/148, 140, 482/142, 91, 93, 121, 123, 126, 132, 135–137, 129, 130, 117; 601/19, 22, 23, 27, 63, 46, 118, 134, 151, 128, 124, 125, 129, 131, 132

(56) References Cited

U.S. PATENT DOCUMENTS 1,936,022 * 11/1933 Hunt .
1,947,042 * 2/1934 Glennan .
2,466,470 * 4/1949 Norris .
2,797,685 * 7/1957 Packwood .
2,988,084 * 6/1961 Douglas .
4,326,508 * 4/1982 Stauffer ..... 128/57
5,027,795 * 7/1991 Kato ..... 601/15
5,105,802 * 4/1992 Pokorny ..... 601/131
5,145,474 * 9/1992 Moore ..... 482/51
5,702,354 * 12/1997 DeSpain et al. ..... 601/27
5,833,587 * 11/1998 Strong et al. ..... 482/123

* cited by examiner

*Primary Examiner*—Jerome W. Donnelly
*Assistant Examiner*—Lori Baker Amerson

(57) ABSTRACT

An abdominal exerciser device comprising a resilient rubber ball rollably engaging a plurality of ball bearings mounted inside an almost complete in height semi-spherical cavity upwardly oriented within a self-standing casing and allowing the rubber ball a free-rolling action when applied against a body part such as the abdominal, waist and/or hips effectively pressuring and massaging the muscles of the body part. One or more casings may also be mounted on absorbing materials themselves mounted onto a rigid frame structure adapted to support a user.

14 Claims, 4 Drawing Sheets

ABDOMINAL EXERCISER DEVICE

CROSS REFERENCE TO RELATED APPLICATION

This application is related to U.S. provisional application for patent No. 60/120,043 filed on Feb. 12, 1999.

FIELD OF THE INVENTION

The present invention relates to exercisers, and more particularly to an abdominal exerciser.

BACKGROUND OF THE INVENTION

Massaging device has been disclosed in the prior art in U.S. Pat. No. 1,936,022 issued on Nov. 21, 1933 to J. V. Hunt. The device comprises a ball held in a semi-spherical frame equipped with a handle that can be manually grasped for applying pressure with the ball, for example on a person's abdominal area. A motor mounted inside a casing attached to the frame allows for vibration of the ball on the abdominal area, where an alleged fat reduction in this area. However, this apparatus is disadvantageous in that it does not fully exercise the abdominal muscles, and one is required to manually hold the device while applying pressure on his abdominal area for the device to have an effect: this can become uncomfortable and tedious, with little or no effective results in abdominal muscles strengthening.

Reducing apparatus has been disclosed in the prior art in U.S. Pat. No. 2,466,470 issued on Apr. 5, 1949 to G. G. Norris. The apparatus comprises a resilient sphere, which can be rolled on a flat surface or on a concaved transversed member disposed along a wall. Areas of the body such as hips and waist may be reduced of excessive fatness through the action of the body part while in contact with the sphere. However, the sphere of this apparatus does not have a free-rolling action and the apparatus is not stand-alone in that for the sphere to have an effect a minimum of two points of contact must be given to the sphere to keep it balanced; this requires the user to constantly change position, which can become discomforting and troublesome.

OBJECTS OF THE INVENTION

It is an object of the present invention to provide an abdominal exerciser that obviates the above noted disadvantages.

An object of the present invention is to provide an abdominal exerciser that allows for a simple way to exercise a person's abdominal muscles.

Another object of the present invention is to provide an exerciser for reducing purposes, on which a body part such as the abdominal, waist and/or hips can be applied for pressuring, massaging, rolling and pounding actions.

A further object of the present invention is to provide an exerciser to which a person can adapt various level of pressure.

A still further object of the present invention is to provide a stand alone exerciser liberating arms and legs which can be mounted at various angles on a more sophisticated structure alone or together with other similar exercisers to ease and facilitate the use by the user.

Another object of the present invention is to provide an exerciser that is easy to build, manufacture and maintain, and adaptable to various comfort level by using adaptable balls and with or without an absorbing material installed below the exerciser.

Further objects and advantages of the invention will be in part obvious from an inspection of the accompanying drawings and a careful consideration of the following description.

SUMMARY OF THE INVENTION

The present invention consists of an abdominal exerciser device comprising a self-standing casing member with an essentially upwardly oriented cavity, at least three ball bearing members secured into the cavity of the casing, and a ball removably engaging the cavity and rollably engaging the bearing members, said casing member includes a top cover member having an essentially circular opening of a diameter slightly larger than the diameter of the ball and engaged by said ball.

Preferably, the bearing members are all coplanar, said bearing members engaging said ball at their respective apex point and said apex points forming a plane intersecting said ball at mid depth of said cavity.

Preferably, the exerciser device further includes a bottom bearing member located at a closed end of said cavity and rollably engaging said ball.

Preferably, there are eight bearing members and said cavity has an essentially circular opening of a diameter slightly larger than the diameter of said ball, the depth of said cavity being essentially equivalent to the radii of said ball, thereby having essentially half of said ball engaged into said cavity, and the other half protruding out of said casing member.

Preferably, the opening being essentially centered with respect to said bearing members, the depth of said cavity being essentially equivalent to the radii of said ball, thereby having essentially half of said ball engaged into said cavity, and the other half protruding out of said casing member.

Additionally, the casing member may further includes additional essentially upwardly oriented cavities, at least three additional ball bearing members for each of said additional cavities and respectively secured therein, and one additional ball removably engaging each one of said additional cavities and rollably engaging its respective additional bearing members, said cavities being in close proximity to each other, said top cover member having additional essentially circular opening of a diameter slightly larger than the diameter of said balls and each engaged by a respective one of said balls.

Also, at least one exerciser device may be combined and mounted onto a rigid frame structure member, said structure member being adapted to support a user in a pre-determined position into which said exerciser devices are positioned for said balls to apply pressure at the hip, waist and/or abdominal regions of said user.

Preferably, the exerciser devices are flexibly mounted onto said structure member using absorbing members, thereby providing some provision for shock absorption by said exerciser devices.

Preferably, the absorbing members are resilient flexible pads onto which said exerciser devices are mounted on.

Preferably, the frame structure member includes a user seat slidably mounted onto an essentially horizontal beam, said exerciser devices mounted on the sides of said beam apply pressure on the waist and hip body parts of said user.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
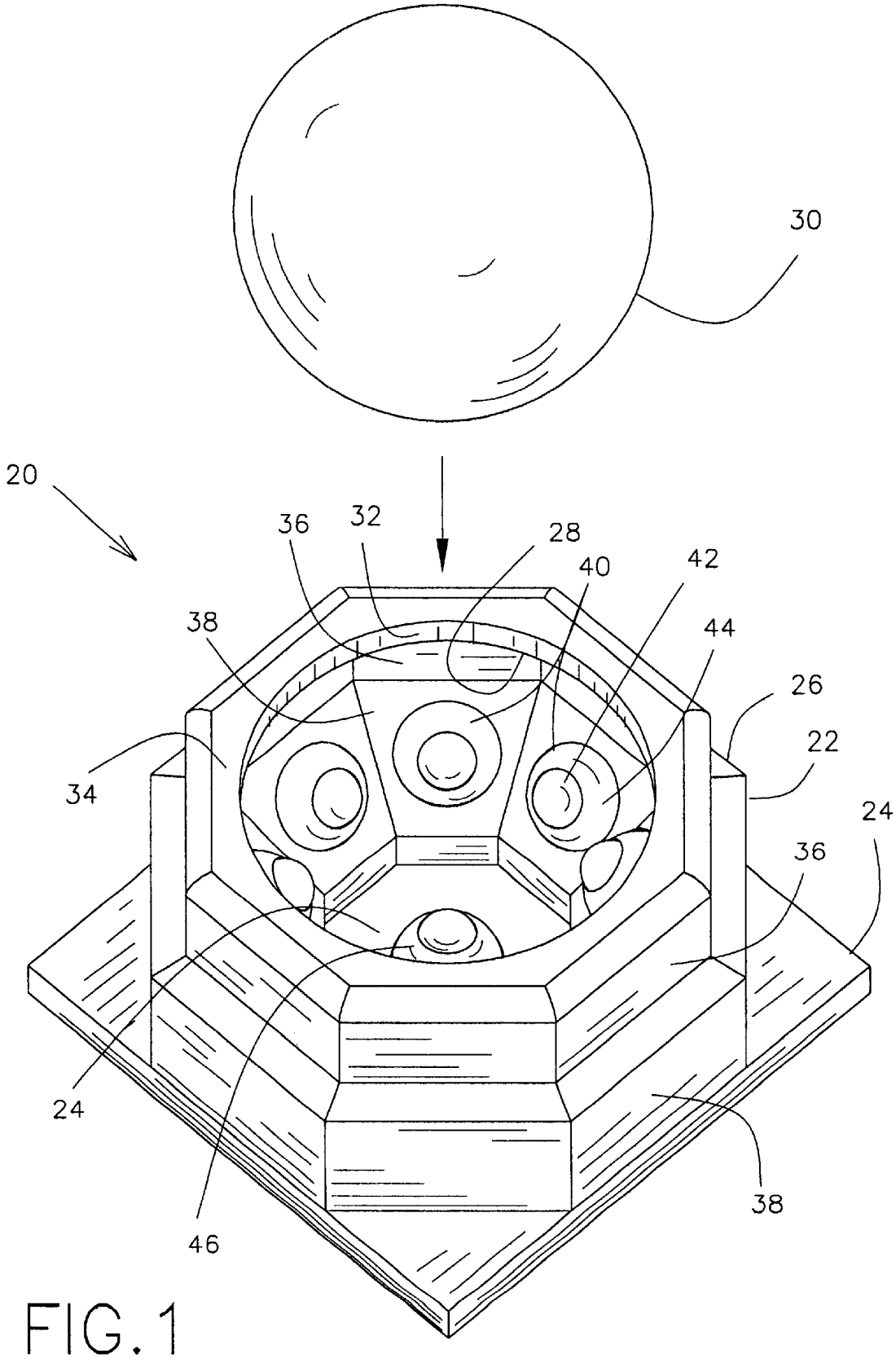
FIG. 1 is a perspective view of the casing of an embodiment according to an abdominal exerciser of the present invention.

Referring to the FIG. 1, the abdominal exerciser 20 according to the present invention shows a self-standing base portion or casing member 22 that includes a lower plate 24, sidewalls 26 secured essentially perpendicularly to the lower plate 24. Lower plate 24 and sidewalls 26 form an essentially upwardly oriented cup shaped cavity 28 adapted to be removably engaged by a ball 30, preferably made out of resilient rubber. The cavity 28 has a generally circular opening 32 with a diameter slightly larger than the diameter of the ball 30 for engagement therein of the latter. Preferably, the opening 32 is part of a top cover 34 secured on its outer edge to the contour of the sidewalls 26. The combined height of the sidewalls 26 and top cover 34 is essentially equal to or slightly larger than the radii of the resilient rubber ball 30. The sidewalls 26 is a multi-sided wall including a generally vertical upper section 36 covering approximately half of the depth of the cavity 28 and terminated at the top by the cover 34, and an essentially internally conical lower section 38 between the upper section 36 and the plate 24 and covering the other half. Preferably, eight bearing members 40, each including a support 42 and its ball bearing 44, are mounted onto the lower section 38 of sidewalls 26. The bearings 40 are peripherally equally spaced and all on a same plane.

Once engaged into the cavity 28, the resilient rubber ball 30 is rollably supported solely by the ball bearings 44 and therefore permitted to rollover itself. Each bearing 40 engages the ball 30 at its own apex point; all apex points forming a plane intersecting the ball 30 between 30% an 70% of the radii, preferably at mid radii. The intersecting plane is essentially parallel to the opening 32.

Figure 2:
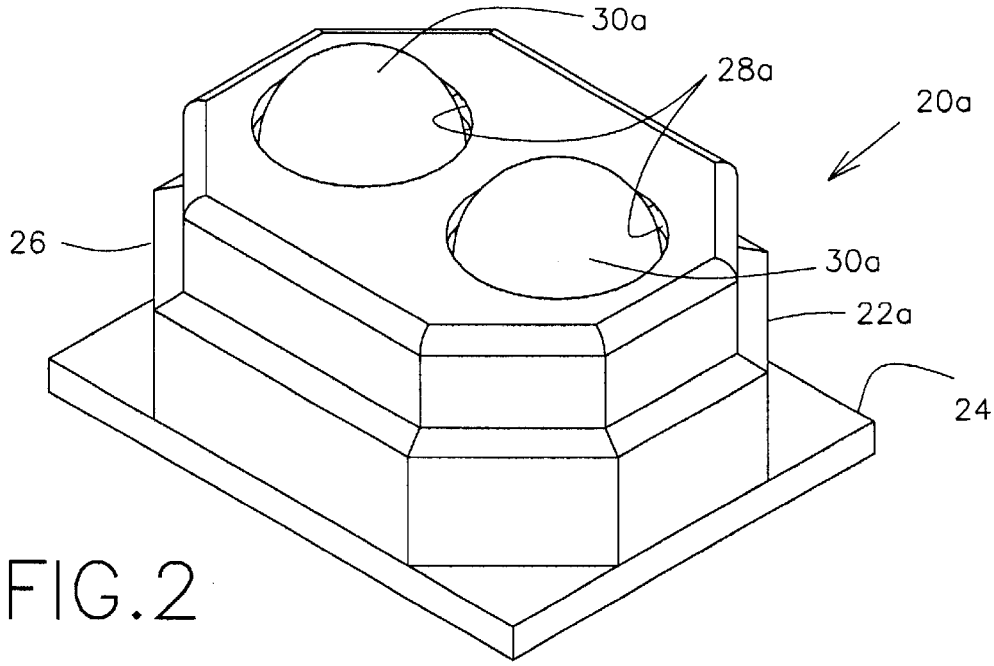
FIG. 2 is a perspective view of another embodiment of an abdominal exerciser showing a casing as in FIG. 1 adapted with two balls.

FIG. 2 represents an abdominal exerciser 20*a* in which the casing 22*a* has been adapted to have two cavities 28*a* to removably receive two resilient rubber balls 30*a*.

The resilient rubber ball 30 may be released from the casing 22 since the circumference of the opening 32 of the top cover 34 is always slightly larger than the circumference of the ball 30 and since the vertical height (or depth) of the combination of the top cover 26 and the cavity 28 is only slightly higher than half the diameter of the ball 30. The ball 30 may be alternatively made out of a relatively soft material or a hard material, but in any event, it must be prevented from excessive deformation upon being loaded with a user's weight as described hereinafter, since it must still be allowed to rollover itself when rollably engaging the bearings 40. In preference, the ball 30 has a diameter of between 5 to 10 inches, preferably 8 inches, and weighs between 1 and 8 kg, such as conventional medicine balls.

The angle of the lower section 38 of the sidewalls 26 is preferably of 45 degrees, but could vary. The depth at which, for example, the eight bearings 40 are positioned inside the cavity 28 will depend of the angle position of that lower section 28, but should allow for a contact at between 30% and 70% of the radii of the ball 30. If the abdominal exerciser 20 is positioned at an angle of up to approximately 45 degrees from horizontal, the ball 30 should still only rest on the bearings 40, depending at which exact depth the latter are positioned, not affecting its use. If the angle of the abdominal exerciser 20 is increased to approximately between 45 degrees and 90 degrees, the ball 30, depending at which exact depth the bearings 40 will be positioned, will also have contact with the inner edge of opening 32, thus preventing the ball 30 from rolling over itself while supported by the bearings 40. It may however still be possible to use the abdominal exerciser 20 under these circumstances when instead of being in contact with the inner edge of the opening 32 the ball 30 is in contact with a region of the user's body and enough pressure is applied onto the ball 30. If the abdominal exerciser 20 is positioned at angles between 90 degrees and 180 degrees and no pressure is applied onto the ball 30, the latter will fall under gravity. Ultimately, it may however still be possible, but not practical, to use the abdominal exerciser 20 using the same principle as explained above when the angle varies between 45 degrees and 90 degrees.

For better ball 30 support within the cavity 28, a bottom bearing member 46 may be secured at a proper level at the closed end of the cavity 28, on the lower plate 24.

The abdominal exercisers 20, 20*a* of FIGS. 1 and 2 respectively are preferably transportable and are typically used while simply laying on the floor with the user's abdominal muscles laid down and applying pressure on the ball 30 that is upwardly oriented. The user then puts more or less pressure, using his/her own weight, on different part of his abdominal muscles by moving his body using the balance provided by his legs and arms. The feet and hands of the user are primarily used as balancing devices rather than the possible support devices since they are in direct contact with the floor. By tilting his body on one side or the other on the ball 30, the latter is allowed to move due to the bearings 40. This tilting motion of the body will effectively allow different muscles of the user's abdominal part to be exercised. Different resilient rubber balls 30 may be used according to the desired level of abdominal training the user wishes, smaller and harder balls requiring more effort than larger and softer balls.

It is also of importance when practicing such an exercise that when a person tilts his body laterally on the ball 30, casing 22 does not hinder this tilting motion.

Figure 3:
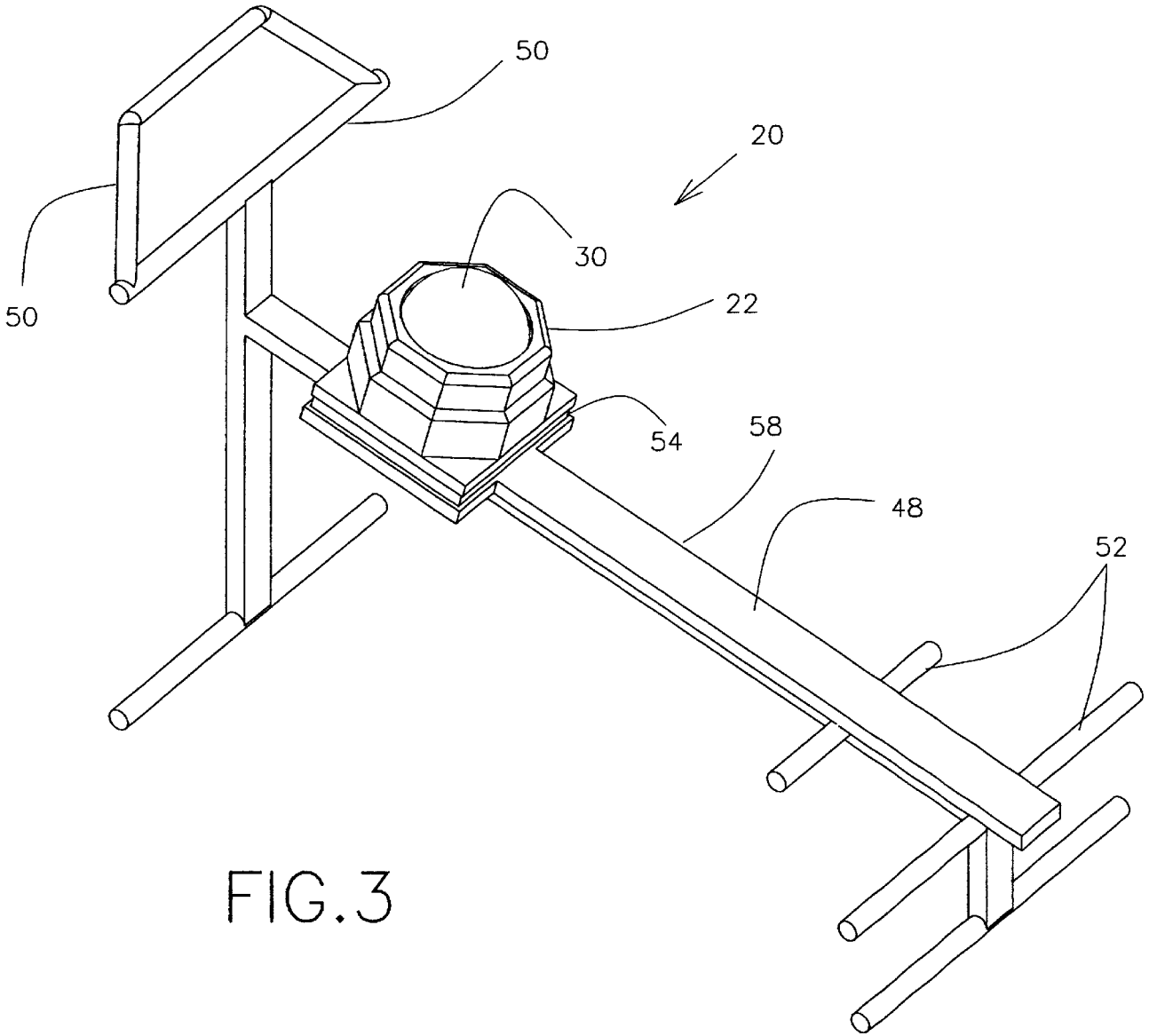
FIG. 3 is a perspective view of the exerciser of the present invention mounted on an absorbing pad onto a frame structure easing the use and effectiveness of the abdominal exerciser.

FIG. 3 shows the abdominal exerciser 20 mounted onto a stable and rigid frame structure member 48 having handles 50 and foot rests 52 for the user to balance and move his/her abdominal body part over the exerciser 20, while being into an almost comfortable horizontal position. The structure 48 is elevated from the floor to ease exerciser 20 accessibility to the user.

Figure 4:
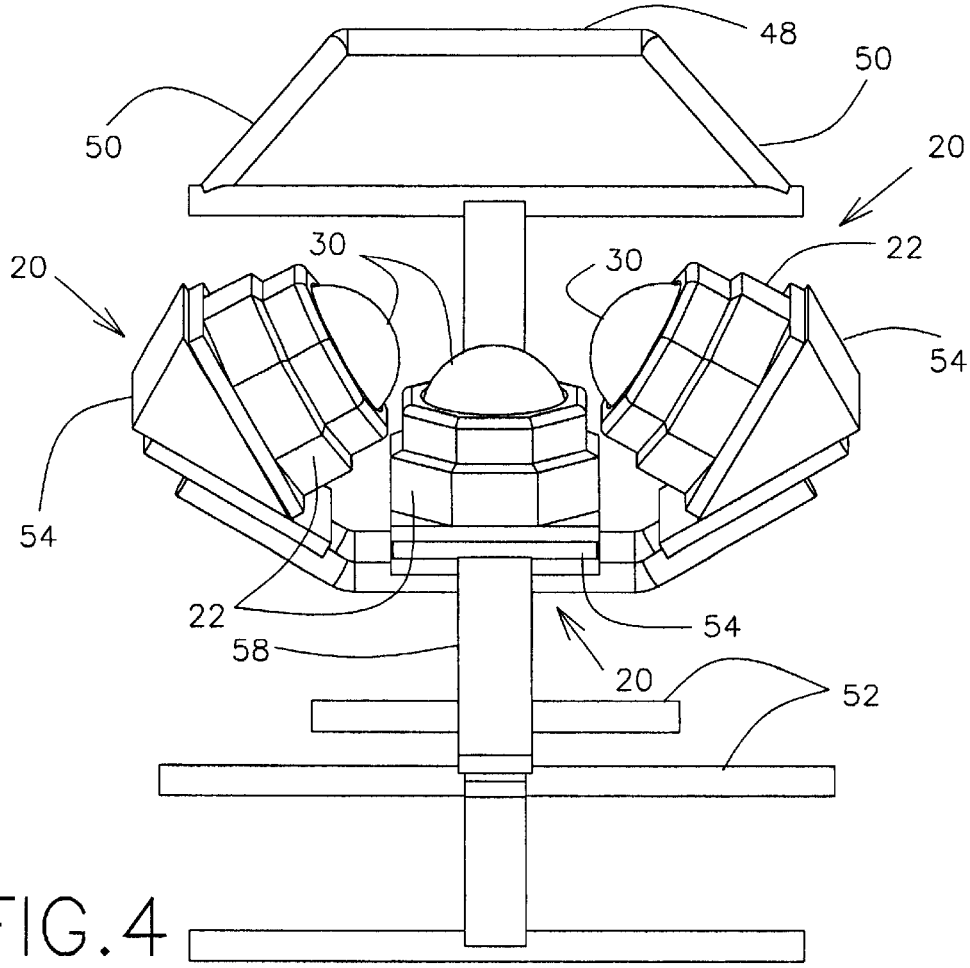
FIG. 4 is a front elevational view of the frame structure of FIG. 3 with three exercisers.

FIG. 4 illustrates a more sophisticated use of the abdominal exerciser 20 where preferably three of them are mounted onto a slightly modified structure 48. Two abdominal exercisers 20 are mounted laterally in order to have their respective ball 30 in contact with the either sides of the user's abdominal body part while another abdominal exerciser 20 is centrally mounted, in order to have its ball 30 in contact with the front part of the user abdominal part. Between the abdominal exercisers 20 and the structure 48, at the mounting area, there is preferably an absorbing material member 54 of some sort to provide further smoothness to the use of the exercisers 20. For the exercisers on both sides, the absorbing material 54 preferably has an angled shape in order to facilitate the positioning of the abdominal exerciser 36 towards an abdominal part of the body.

Figure 5:
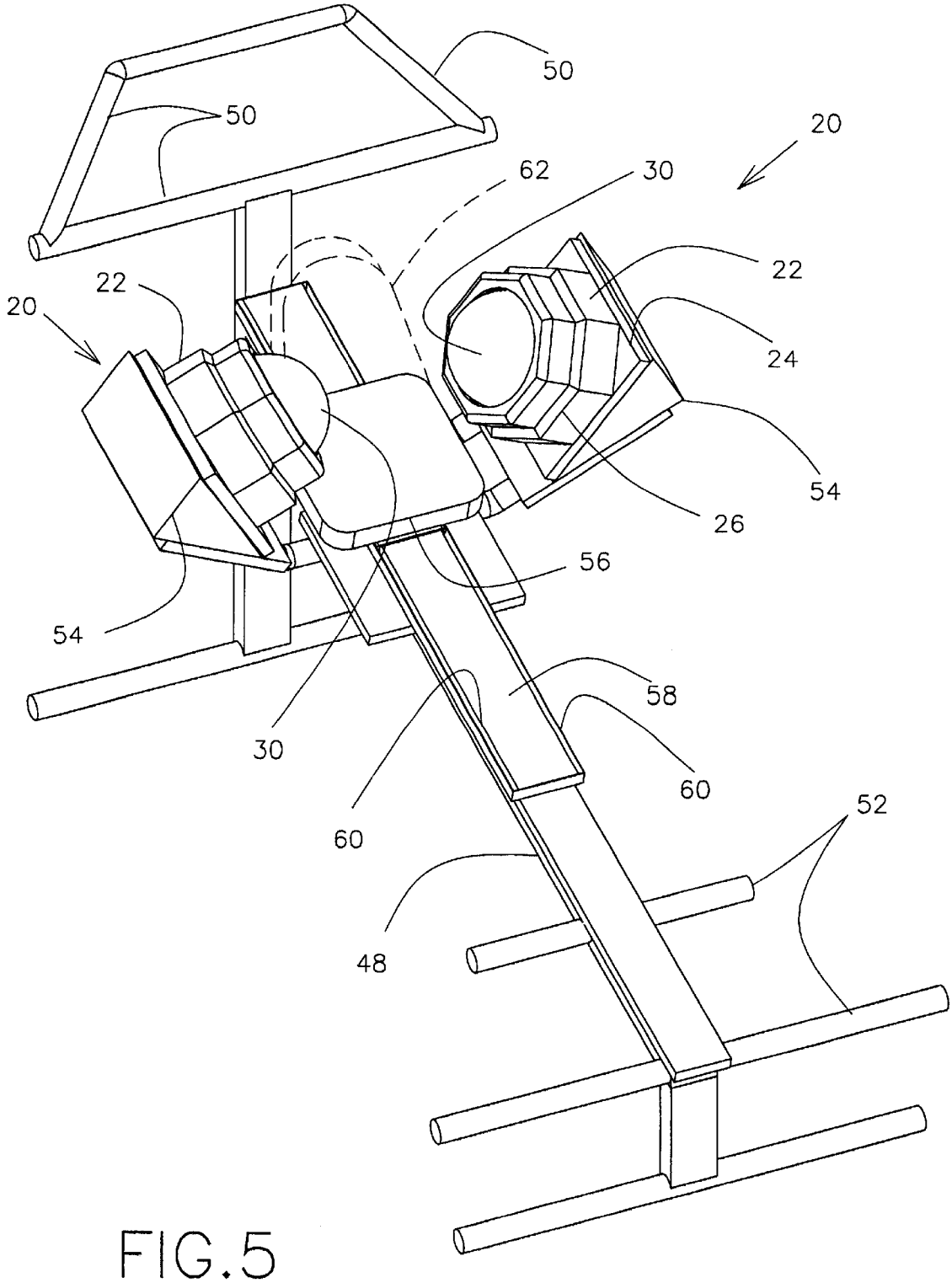
FIG. 5 is a view similar to FIG. 3 showing the frame structure having a sliding seat in between two exercisers.

In order to better exerciser the waist and hip body parts, the structure 48, as shown in FIG. 5, is preferably provided with a sliding seat 56 replacing the central exerciser 20 of FIG. 4. The seat 56 slidably mounted onto a slightly inclined beam 58 of the structure 48 is upwardly displaced away from the foot rests 52 by the user gently pushing with his/her feet and downwardly displaced towards the foot rests 52 under the gravity due to the inclination of the beam 58. The seat 56 is preferably mounted on small wheels (not shown) rollably engaging support rails 60 on each side of beam 58. Preferably, the seat 56 may include a backrest 62 (shown in dashed lines) for better comfort of the user.

All the above exercisers 20 are specifically used to either reinforce, train or make firmer the different muscles of the waist, hip and abdominal body parts of the user.

Although embodiments have been described herein with some particularity and details, many modifications and variations of the preferred embodiment are possible without deviating from the scope of the present invention.

I claim:

1. An abdominal exerciser device comprising a self-standing casing member with an essentially upwardly oriented cavity, at least three ball bearing members secured into said cavity of said casing, and a ball removably engaging said cavity and rollably engaging said bearing members, said casing member includes a top cover member having an essentially circular opening of a diameter slightly larger than the diameter of said ball and engaged by said ball.

2. An exerciser device as defined in claim 1, wherein said bearing members are all coplanar, said bearing members engaging said ball at their respective apex point and said apex points forming a plane intersecting said ball at mid depth of said cavity.

3. An exerciser device as defined in claim 2, further including a bottom bearing member located at a closed end of said cavity and rollably engaging said ball.

4. An exerciser device as defined in claim 2, wherein there are eight bearing members and said cavity has an essentially circular opening of a diameter slightly larger than the diameter of said ball, the depth of said cavity being essentially equivalent to the radii of said ball, thereby having essentially half of said ball engaged into said cavity, and the other half protruding out of said casing member.

5. An exerciser device as defined in claim 2, wherein said opening being essentially centered with respect to said bearing members, the depth of said cavity being essentially equivalent to the radii of said ball, thereby having essentially half of said ball engaged into said cavity, and the other half protruding out of said casing member.

6. An exerciser device as defined in claim 1, further including a bottom bearing member located at a closed end of said cavity and rollably engaging said ball.

7. An exerciser device as defined in claim 1, wherein said cavity has an essentially circular opening of a diameter slightly larger than the diameter of said ball, the depth of said cavity being essentially equivalent to the radii of said ball, thereby having essentially half of said ball engaged into said cavity, and the other half protruding out of said casing member.

8. An exerciser device as defined in claim 1, wherein said opening being essentially centered with respect to said bearing members, the depth of said cavity being essentially equivalent to the radii of said ball, thereby having essentially half of said ball engaged into said cavity, and the other half protruding out of said casing member.

9. An exerciser device as defined in claim 1, wherein said casing member further includes additional essentially upwardly oriented cavities, at least three additional ball bearing members for each of said additional cavities and respectively secured therein, and one additional ball removably engaging each one of said additional cavities and rollably engaging its respective additional bearing members, said cavities being in close proximity to each other, said top cover member having additional essentially circular opening of a diameter slightly larger than the diameter of said balls and each engaged by a respective one of said balls.

10. An exerciser device as defined in claim 9, further including a bottom bearing member for each one of said cavities, located at a closed end therein and rollably engaging its respective one of said balls.

11. A combination of at least one exerciser device comprising a casing member mounted onto a rigid frame structure member and having an essentially upwardly oriented cavity, at least three ball bearing members secured into said cavity of said casing, and a ball removably engaging said cavity and rollably engaging said bearing members, said structure member being for supporting a user in a predetermined position into which said exerciser devices are positioned for said balls to apply pressure at the hip, waist and/or abdominal regions of said user.

12. The combination of claim 11, wherein said exerciser devices are flexibly mounted onto said structure member using absorbing members, thereby providing some provision for shock absorption by said exerciser devices.

13. The combination of claim 12, wherein said absorbing members are resilient flexible pads onto which said exerciser devices are mounted on.

14. The combination of claim 11, wherein said frame structure member includes a user seat slidably mounted onto an essentially horizontal beam, said exerciser devices mounted on the sides of said beam apply pressure on waist and hip body parts of said user.

* * * * *